US006059473A

United States Patent [19]

Gueret

[11] Patent Number: 6,059,473

[45] **Date of Patent: *May 9, 2000**

[54] APPLICATOR FOR APPLYING A LIQUID COSMETIC PRODUCT AND MAKE-UP ASSEMBLY PROVIDED WITH SUCH AN APPLICATOR

[75] Inventor: Jean-Louis Gueret, Paris, France

[73] Assignee: L'Oreal, Paris, France

[ * ] Notice: This patent is subject to a terminal disclaimer.

[21] Appl. No.: 08/500,781

[22] Filed: Jul. 11, 1995

[30] Foreign Application Priority Data

Jul. 12, 1994 [FR] France ..... 94 08655

[51] Int. Cl.[7] ..... A46B 11/00

[52] U.S. Cl. ..... 401/129; 401/126

[58] Field of Search ..... 401/129, 126, 401/130, 127, 128; 15/143.1

[56] References Cited

U.S. PATENT DOCUMENTS

| | | | |
|---|---|---|---|
| 571,367 | 11/1896 | Higgins | 401/129 |
| 643,803 | 2/1900 | Schott | 401/127 |
| 1,478,388 | 12/1923 | Gray | 15/143.1 X |
| 1,795,651 | 3/1931 | Hunter | 15/143.1 |
| 1,999,642 | 4/1935 | Shepherd . | |
| 2,158,901 | 5/1939 | Gordon | 401/128 |
| 2,296,139 | 9/1942 | Blair . | |
| 2,664,582 | 1/1954 | Kammann | 15/143.1 |
| 2,990,076 | 6/1961 | Stull . | |
| 3,008,169 | 11/1961 | Dearling . | |
| 3,087,191 | 4/1963 | Plunkett | 401/130 |
| 3,271,807 | 9/1966 | Cabot | 401/130 |
| 3,601,838 | 8/1971 | Marx | 15/143.1 X |
| 4,509,540 | 4/1985 | Inagaki . | |
| 4,712,936 | 12/1987 | Kessler . | |
| 4,927,281 | 5/1990 | Gueret | 401/129 |
| 5,020,551 | 6/1991 | Guerret | 401/129 X |
| 5,107,870 | 4/1992 | Beck et al. | 401/129 X |
| 5,357,647 | 10/1994 | Gueret . | |
| 5,491,865 | 2/1996 | Gueret . | |

FOREIGN PATENT DOCUMENTS

| | | | |
|---|---|---|---|
| 0 509 852 | 10/1992 | European Pat. Off. . | |
| 1.052.211 | 1/1954 | France . | |
| 1.174.544 | 3/1959 | France . | |
| 85.853 | 9/1965 | France . | |
| 2 564 712 | 11/1985 | France . | |
| 425254 | 2/1926 | Germany | 401/130 |
| 57-017610 | 1/1982 | Japan . | |
| 155730 | 7/1932 | Switzerland . | |
| 2082553 | 3/1982 | United Kingdom | 401/129 |
| 2159699 | 12/1985 | United Kingdom | 401/129 |

*Primary Examiner*—David J. Walczak
*Attorney, Agent, or Firm*—Finnegan, Henderson, Farabow, Garrett & Dunner, LLP

[57] ABSTRACT

The present invention relates to an applicator for applying a make-up product, including a stem (5) having a free end **(5*a*) comprising an embedment plane for an application member having a defined flexibility, the stem having a flexibility similar to that of the application member, the stem and the application member being manufactured as a single piece. Preferably, the application member consists of a tuft (2) of bristles (3)**. The invention also relates to a nail-varnish application assembly provided with such an applicator.

18 Claims, 3 Drawing Sheets

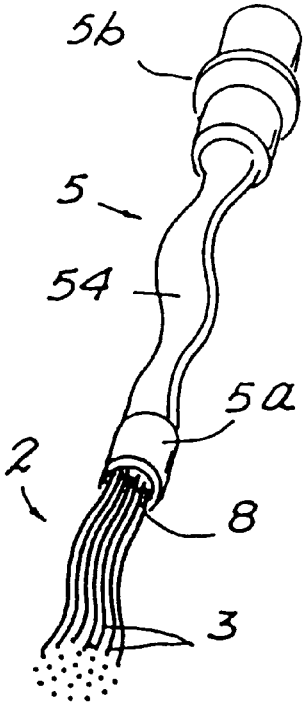
FIG. 5
FIG. 6
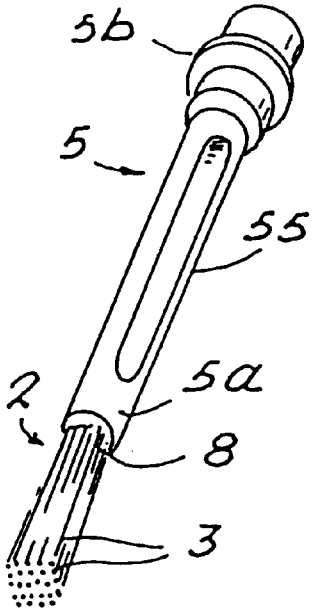
FIG. 19
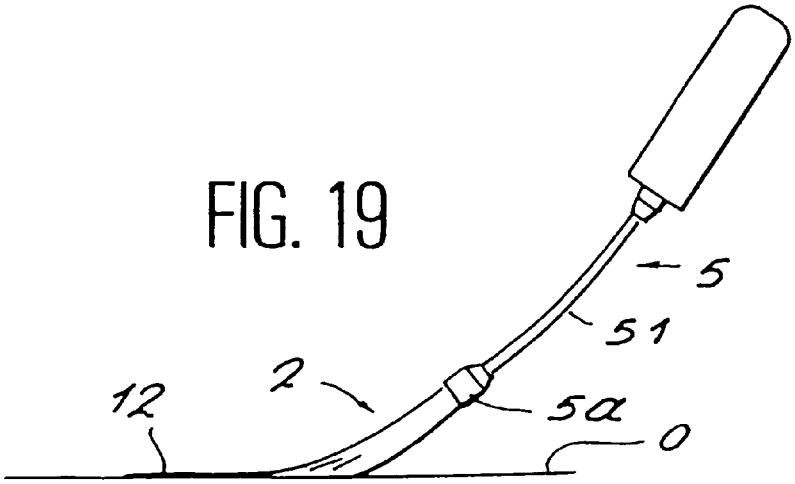

APPLICATOR FOR APPLYING A LIQUID COSMETIC PRODUCT AND MAKE-UP ASSEMBLY PROVIDED WITH SUCH AN APPLICATOR

The present invention relates to an applicator for applying a liquid, pasty or pulverulent cosmetic product, such as a nail varnish, a liquid lip colour, or else a liquid foundation or an eyeshadow. It also relates to a cosmetic-product application assembly equipped with such an applicator.

Generally, a liquid-cosmetic-product application assembly comprises a reservoir for the product to be applied and an applicator for applying the said product, such as a brush including a tuft of bristles, this tuft being fixed to a support called a brush stem. This assembly furthermore comprises a sleeve intended to close the reservoir, the brush stem being fixed in this sleeve so that the tuft of bristles is immersed in this product.

Brushes provided up to now leave something to be desired as regards the uniformity and gentleness of application, and, especially as regards the application of a varnish to the nails, the speed of making-up. Thus, with a conventional nail-varnish brush, it often happens that the user deposits a non-uniform layer of varnish, marked by streaks coming from the bristles of the brush. This effect is even more pronounced if a second layer of varnish is deposited on the nails when the first layer has not completely dried.

Furthermore, a conventional make-up brush requires a complicated manufacture, consisting successively in firstly moulding the stem, in cutting the bristles, in arranging them into a tuft, in fixing the tuft onto the brush stem and, finally, in cutting the bristles of the tuft to the desired length. In a conventional nail-varnish brush, the stem is made of rigid or semi-rigid thermoplastic, and the bristles are most often made of nylon or of polyester having a diameter of approximately $^{4}/_{100}$th to $^{10}/_{100}$th of a mm. The embedment of these bristles in the stem may only be performed by a specialized tool. These conventional bristles are extruded and, because of their small diameter, they cannot be manufactured, for example, by moulding. Understandably this manufacture leads to a relatively high production cost.

One solution for decreasing this production cost would consist in producing, as a single piece, a rod with bristles having a larger diameter, for example a diameter of $^{30}/_{100}$th of a mm, but tests carried out by the Applicant have shown that a varnish deposited with such an applicator with large bristles exhibited unattractive streaks in the layer of varnish deposited, which it is endeavoured to avoid. The Applicant Company has therefore sought a solution to the above drawbacks.

The object of the present invention is, especially, to provide a make-up applicator which makes it possible to apply make-up uniformly, making application very easy for the user, while at the same time having as economic as possible a production cost and not forming streaks.

Surprisingly, the Applicant has observed that, by varying the flexibility of the stem of an applicator, it was possible to use relatively stiff, but mouldable, bristles, for a nail-varnish applicator. In this case, it was observed that the applicator draws the product over the surface of the nail by capillary effect. Consequently, the applicator "floats" over the layer of varnish deposited, without scratching and without forming streaks. Furthermore, it even removes all types of streaks, and a second layer of varnish may be applied right after the first layer has been spread without waiting for it to dry, which shortens the overall application time. Likewise, the Applicant Company has observed that an applicator provided with a flexible stem makes it possible to use varnishes having a viscosity outside the range normally used.

The Applicant has furthermore observed that, by increasing the flexibility of the stem of an applicator, it was possible to obtain a layer of varnish on a nail much more uniformly than with an applicator having a rigid stem, without forming streaks.

Thus, the invention relates to an applicator for applying a make-up product, including a stem having a free end comprising an embedment plane for an application member having a defined flexibility, the stem having a flexibility similar to that of the application member, the stem and the application member being manufactured as a single piece.

By the phrase "flexibility similar to the application member" is meant a flexibility such that, when applying the product to a surface, for example a varnish to a nail, the application member and the flexible part of the stem form a curve with a virtually constant curvature, especially in the form of an arc of a circle. This flexibility of the stem is chosen, especially, so that the force F to be applied in order to bend the stem lies within the range: $0.3f<F<3f$, f being the force necessary to bend the application member. Preferably, the flexibility of the stem is chosen to be at most equal to that of the application member.

In addition to the advantages mentioned above, the applicator of the invention can be manufactured with an advantageous cost and ensures that making-up is easy and of good quality.

Advantageously, the manufacture of the stem and of the application member is carried out in a single moulding step—the stem and the application member are moulded as a single piece, especially made of a single thermoplastic. It is also possible to produce the stem and the application member from two different, chemically compatible, materials; in this case, the application member is fixed to the stem by two-shot moulding or over-moulding.

Preferably, the thermoplastic has a hardness chosen from the range of from 15 Shore A to 40 Shore D and preferably from 90 to 95 Shore A. According to a preferred embodiment, the thermoplastic is HDPE or LDPE (high-density or low-density polyethylene). Other materials may be used, such as polyacetals, polyamides, polyether-block-amides and polyester elastomers or polyurethane elastomers.

According to the invention, the stem has a length advantageously chosen from the range from 2 to 20 cm and preferably from 2 to 4 cm.

According to the invention, the stem has a defined cross-section and advantageously includes, in its central part, at least one region of smaller cross-section capable of conferring on the stem the desired flexibility.

In principle, the stem can have a cross-section of any shape but, according to the invention, a circular or flat cross-section is preferred. In the case of a stem having a circular cross-section, this has a diameter which may range from 2.5 to 5 mm and preferably from 2.5 to 3.5 mm. In general, the cross-section of the stem lies within the range going from 4 to 20 $mm^2$ and preferably from 6 to 12 $mm^2$.

Advantageously, the region of smaller cross-section is a cross-section lying within the range from 0.2 to 1.8 $mm^2$ and preferably from 0.4 to 1.2 $mm^2$.

More generally, the region of smaller cross-section (s) is a cross-section chosen so that the ratio S/s lies between 2 and 100, S being the largest cross-section of the stem, s the smallest cross-section.

In particular, according to another possibility for conferring on the stem the desired flexibility, this stem may include at least one flattened, recessed, spiral-shaped or concertina-shaped region.

The application member may be shaped in the form of at least one loop, of a spatula, of a plume or of a tuft of bristles, this loop, spatula, plume or tuft possibly being covered with a flock coating. When a spatula or a plume is produced, it may include at least one slot and/or at least one recess, promoting storage and flow of the product.

When a tuft of bristles is produced, the embedment plane for the tuft advantageously includes a number of bristles which is chosen from the range going from 4 to 40 and preferably from 8 to 35. Advantageously, these bristles have a length ranging from 8 to 40 mm and preferably from 11 to 25 mm. They may have a thickness chosen from the range going from 0.2 to 1.5 mm and preferably from 0.5 to 1 mm. These bristles may have a cross-section whose shape is chosen from cylindrical, polygonal or cruciform shapes, or shapes in the form of a C, in the form of an L, in the form of an I, in the form of an H or in the form of a V, or including at least one capillary groove over at least part of their length. At least part of these bristles may have slight corrugations over at least part of their length.

In accordance with the invention, the cross-section of the tuft may have any shape. Thus, the embedment plane of the application member may have a shape chosen from circular, polygonal or rectangular shapes, or shapes having a circular, oval or cruciform cross-section. Advantageously, the bristles are arranged in a staggered configuration, but it is possible to arrange them on a straight or curved row. The distance between the bristles is chosen depending on the amount of product take-up desired and/or on the viscosity of the product.

The free end of the bristles may undergo an abrasive or heat treatment, using flame brushing, grinding or carding. Thus, it is possible to obtain bristles whose end is shaped in the form of a pinhead or is tapered, this increasing the amount of product taken up by the applicator, and therefore its autonomy of application.

The free end of the applicator may be flat, rounded or cut so that it slopes.

Advantageously, the thermoplastic may contain an agent modifying its surface finish and/or its slip characteristics and/or reducing its wettability to water and/or to solvent. This agent may be present in a proportion lying between 0.2% and 15% by weight and preferably between 0.3% and 5% by weight.

This slip agent is preferably chosen from the group formed by polytetrafluoroethylene, boron nitride, molybdenum disulphide, graphite, silicones, fullerene, talc.

The applicator having the characteristics which have just been described is particularly suitable for applying a nail varnish, a liquid make-up or a hair dye, especially a nail varnish having a high viscosity.

In the case of a varnish, this may be a composition which may or may not include toluene or formol; it may also include a solvent system comprising water and/or alcohols.

The present invention also relates to a nail-varnish application assembly consisting of a reservoir, generally made of glass, equipped with a neck and with a sleeve integral with a stem provided with an application member immersed, in the storage position, in a nail varnish contained in this reservoir, which assembly is characterized in that it is equipped with an applicator, as defined previously.

The invention consists, apart from the arrangements expounded hereinabove, of a certain number of other arrangements which will be explained in more detail later, with regard to embodiment examples which are described with reference to the appended drawings but which are in no way limiting.

FIGS. 2 to 6 represent various embodiments of an applicator with a flexible stem in accordance with the invention.

FIG. 19 shows an applicator in accordance with the invention during application.

Figure 1:
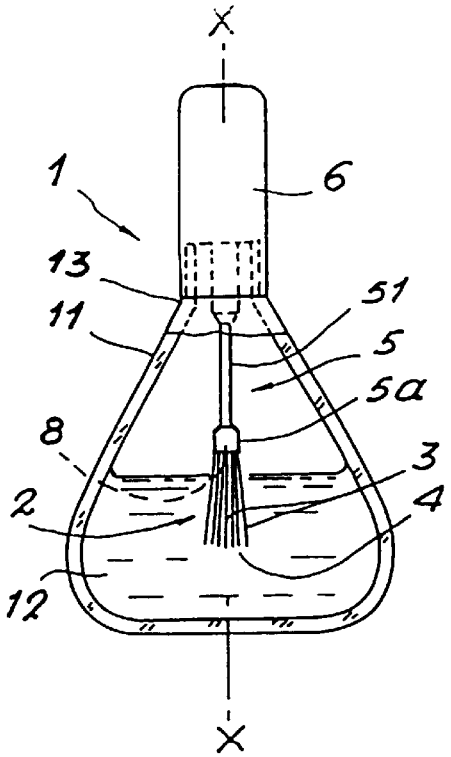
FIG. 1 is a simplified elevation view of a nail-varnish assembly according to the invention.

Referring to FIG. 1 of the drawings, a nail-varnish assembly may be seen which comprises a brush (1) for applying the varnish, the brush (1) being provided with a tuft (2) of bristles (3), this tuft being fixed at a free end **(5*a*) of a flexible stem (5)** and oriented substantially along the axial direction of the stem. The flexible stem and the bristles are made of a single thermoplastic, for example high-density or low-density polyethylene (HDPE or LDPE). This stem/bristle assembly may be obtained in a single step, for example by injection moulding. It is also possible to produce the stem and the tuft from two different, chemically compatible, materials; in this case, the tuft of bristles is fixed to the stem by two-shot moulding or over-moulding. Thus, a stem/bristle subassembly may be produced by two-shot moulding, firstly by injecting a stem made of high-density polyethylene (HDPE) and then by injecting the bristles of the tuft made of a polyethylene elastomer or of a polyether-block-amide elastomer.

The stem (5) is cylindrical with a diameter of approximately 2.5 to 5 mm. Its length is especially 4 cm. A central region (51), of smaller cross-section which may range from 0.2 to 1.8 $mm^2$, is provided on this stem conferring on it a defined flexibility, similar to that of the tuft (2) of bristles (3). This region (51) may be seen more clearly in FIG. 2 and may have a length lying within the range going from 2 to 20 mm. A cylindrical sleeve (6) is integral with the other end **(5*b*) of the stem (5) opposite the tuft (2), this end (5*b*) being shaped in the form of a fastening cap forcibly inserted into the sleeve (6). This sleeve (6) serves as a member for handling the brush. It also serves as a stopper intended, especially, to be screwed onto the neck (13) of a bottle (11) of varnish. The varnish bears the reference (12)**.

FIGS. 2 to 6 illustrate various embodiment examples of a brush provided with a flexible stem including bristles moulded integrally with the stem.

Figure 2:
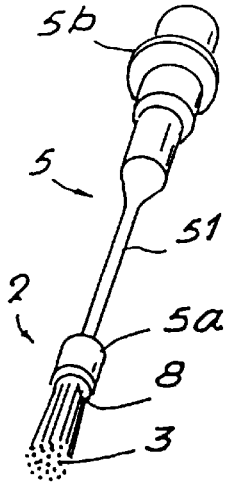

Thus, FIG. 2 shows, in enlarged view, the brush represented in FIG. 1, the flexible stem (5) of which is cylindrical and provided with a first end **(5*a*) including an embedment plane (8) for a tuft (2) of bristles (3). A second end (5*b*) of the stem is shaped in the form of a fastening cap intended to be forcibly inserted into the sleeve (6) in order to fasten it to the flexible stem. The stem is cylindrical and is advantageously made of HDPE (high-density polyethylene), including a region (51) of smaller diameter conferring on the stem a defined flexibility and extending virtually the entire length of the stem. The stem has a normal cross-section of approximately 4.0 to 20 $mm^2$ and the region (51) has a cross-section of approximately 0.2 to 1.8 $m^2$. The region (51)** of smaller cross-section is a section chosen so that the ratio S/s lies between 2 and 100, s being the smallest cross-section and S the largest cross-section.

Figure 3:
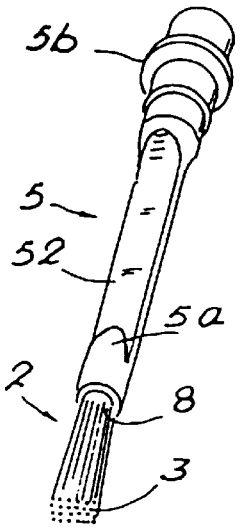

FIG. 3 shows a brush whose stem (5) is formed, over the major part of it, by a flat strip (52) in the form of an elongate tongue.

Figure 4:
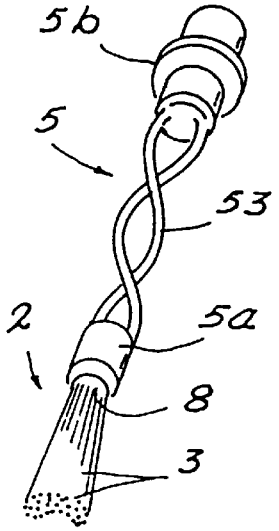

FIG. 4 shows a brush whose stem (5) is formed, in part, by two strips (53) arranged in the form of two entwined helices forming a twin-start spiral.

FIG. 5 shows a brush whose stem (5) is formed, over the major part of it, by a flat strip (54) which is shaped in the form of a "concertina" or includes corrugations.

The brush of FIG. 6 has substantially the same shape as that of FIG. 2, with the exception that the stem (5) is cylindrical but includes a longitudinal slot (55) for ensuring flexibility of the stem.

Capillary reserves for the product to be applied are thus created, making it possible to vary the charge of product depending on its viscosity.

Figure 7:
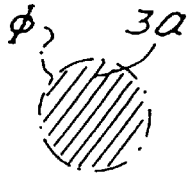
FIGS. 7 to 14 are diagrams of various possible cross-sections of the bristles.
Figure 8:
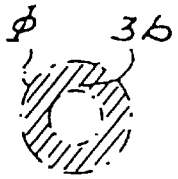
Figure 9:
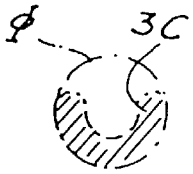
Figure 10:
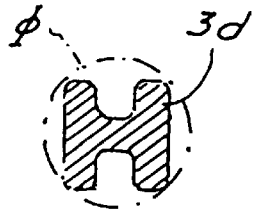
Figure 11:
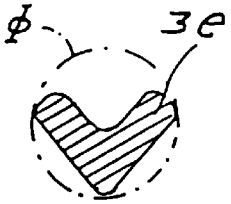
Figure 12:
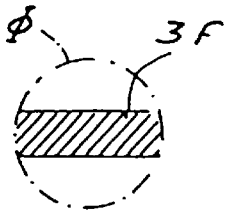
Figure 13:
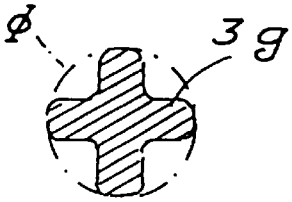
Figure 14:
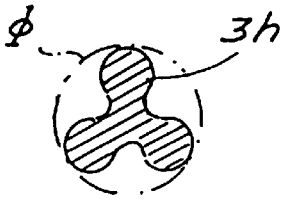
Figure 15:
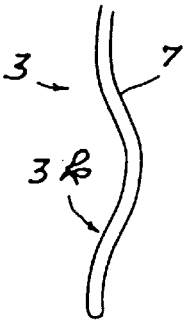
FIG. 15 shows a bristle having a slight corrugation.

As may be seen in FIGS. 7 to 14, the cross-sections of the bristles (3) are inscribed in a circle (ϕ) of diameter lying between 0.2 and 1.5 mm; preferably the cross-section is chosen to fall in the diameter range going from 0.5 to 1 mm. The cross-sections of the bristles (3) may have variable shapes they may be solid circular (3*a*) as illustrated in FIG. 7, hollow circular (3*b*) as illustrated in FIG. 8, C-shaped (3*c*) as may be seen in FIG. 9, H-shaped (3*d*) or V-shaped (3*e*) as may be seen in FIGS. 10 and 11 respectively; they may have a flat shape (3*f*) as may be seen in FIG. 12 or may be polygonal, in particular square or cruciform (3*g*) as may be seen in FIG. 13; or else they may be three-lobed, including capillary grooves (3*h*), as illustrated in FIG. 14. According to the embodiment of FIG. 15, the bristles (3*k*) may not be straight but have, at least over part of their length, slight corrugations (7). At least the free end of the bristles may also be arranged to have a tapered shape obtained, for example, by grinding or by carding. This makes it possible to increase the amount of product taken up by the brush, and therefore its autonomy.

Figure 16:
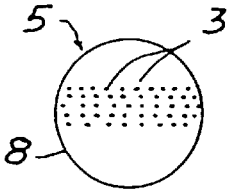
FIGS. 16 to 18 illustrate possible cross-sections showing the embedment plane of the application member.
Figure 17:
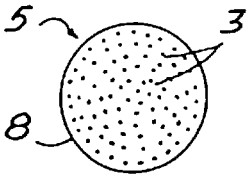
Figure 18:
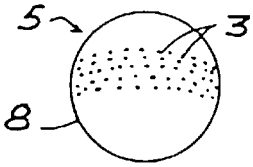

The brush (1) at its tuft (2) may have various cross-sectional shapes—according to FIG. 16, the embedment plane (8) of the tuft (2) is flat and of substantially rectangular shape. According to FIG. 17, this plane (8) of the tuft is circular. Advantageously, the brush may also have a rounded tile shape, a corresponding embedment plane being visible in FIG. 18. Such a brush matches the shape of the nail better.

FIG. 19 shows a brush with a flexible stem, according to the invention, during application of a varnish (12) on a nail (O). It may be seen that the tuft (2) of bristles and the flexible part (51) of the stem (5) form a virtually constant curve, substantially an arc of a circle, so that the tuft (2) is in contact with the nail (O) substantially tangentially.

When a cylindrical brush in accordance with the present invention is produced, the diameter of the tuft (2) of the bristles (3) generally lies within the range from 0.5 to 6 mm—by virtue of the use of a flexible stem, as described previously, a brush is obtained which, during application, draws the varnish (12) instead of pushing it, as in a conventional brush.

The brush in accordance with the present invention is easy to produce, at an advantageous production cost.

The applicator having the characteristics which have just been described is particularly suitable for applying a nail varnish (12), a liquid make-up or a hair dye, especially a varnish having a high viscosity. This varnish may be a composition which may or may not include toluene or formol and this varnish may also include a solvent system comprising water and/or alcohols.

The layer of varnish deposited by such an applicator is very uniform, thick, deposited accurately and has, after drying, improved adhesion properties. The surface has a shiny appearance. The varnish may be deposited in a single go or possibly in two goes, it being possible for the second layer to be deposited on the first, before this has dried. No streaks are formed.

I claim:

1. An applicator for applying a cosmetic product, comprising:

a plastic flexible stem having a first end and a second end;

a plastic flexible application member on the first end of the stem, the stem and the application member being manufactured as a single piece and the stem being at least as flexible as the application member; and a handling member on the second end of the flexible stem, wherein both the application member and the stem are configured to flex upon application of said cosmetic product to a surface.

2. An applicator according to claim 1, wherein the application member is a tuft of bristles, a first end of which is fixed to said first end of the stem.

3. An applicator according to claim 2, wherein the tuft of bristles has a length from 8 to 40 mm.

4. An applicator according to claim 2, wherein the bristles have a thickness in the range of approximately 0.2 mm to approximately 1.5 mm.

5. An applicator according to claim 1, wherein the application member is a coated with a flock coating.

6. An applicator according to claim 1, wherein the flexible stem and application member are made of a thermoplastic material.

7. An applicator according to claim 6, wherein the thermoplastic material has a hardness lying within the range from 15 Shore A to 40 Shore D.

8. An applicator according to claim 1, wherein the flexible stem and application member are made from a material chosen from polyethylenes, polyacetals, polyamides, polyether-block-amides, polyester elastomers, and polyurethane elastomers.

9. An applicator according to claim 1, wherein the stem has a diameter from 2.5 to 5 mm.

10. An applicator according to claim 1, wherein the stem has a length from 2 to 20 cm.

11. The applicator of claim 1, wherein the stem includes a first region and a second region, the second region having a cross-section less than that of the first region.

12. The applicator of claim 11, wherein a ratio of the cross-section of the first region to the cross-section of the second region is ranges from 2:1 to 100:1.

13. An applicator for applying nail varnish, comprising:

a plastic flexible stem having a first end and a second end;

a plastic flexible application member on the first end of the stem, the stem and the application member being manufactured as a single piece and the stem being at least as flexible as the application member; and a handling member on the second end of the flexible stem, wherein both the application member and the stem are configured to flex upon application of said nail varnish to a nail.

14. A cosmetic product application system, comprising:

a plastic flexible stem having a first end and a second end;

a plastic flexible application member on the first end of the stem, the stem and the application member being manufactured as a single piece and the stem being at least as flexible as the application member;

a handling member on the second end of the stem; and a reservoir configured to contain the cosmetic product and to receive the application member, wherein both the application member and the stem are configured to flex upon application of said cosmetic product to a surface.

15. The system according to claim 14, wherein the application member is a tuft of bristles, and a first end of which is fixed to the first end of the stem.

16. The system of claim 14, further comprising a cosmetic product contained in the reservoir.

17. A nail varnish application system, comprising:

a plastic flexible stem having a first end and a second end;

a plastic flexible application member on the first end of the stem, the stem and the application member being manufactured as a single piece and the stem being at least as flexible as the application member;

a handling member on the second end of the stem; and a reservoir configured to contain the nail varnish and to receive the application member, wherein both the application member and the stem are configured to flex upon application of said nail varnish to a nail.

18. The system of claim 17, further comprising nail varnish contained in the reservoir.

* * * * *

UNITED STATES PATENT AND TRADEMARK OFFICE

CERTIFICATE OF CORRECTION

PATENT : 6,059,473

DATED : May 9, 2000

INVENTOR(S) : Jean-Louis H. Gueret

It is certified that error appears in the above-identified patent and that said Letters Patent is hereby corrected as shown below:

In claim 12, column 6, line 55, "is" should be deleted.

Signed and Sealed this

Twentieth Day of March, 2001

*Attest:*

Nicholas P. Godici

NICHOLAS P. GODICI

*Attesting Officer*

*Acting Director of the United States Patent and Trademark Office*